US006146121A

United States Patent [19]

Fox et al.

[11] Patent Number: 6,146,121

[45] Date of Patent: Nov. 14, 2000

[54] ROTOR FOR USE IN A ROTARY PUMP

[75] Inventors: Robert Fox, Henley-on-Thames; Morgan Heikal, Brighton, both of United Kingdom

[73] Assignee: APV UK Limited, Berkshire, United Kingdom

[21] Appl. No.: 09/022,710

[22] Filed: Feb. 12, 1998

[30] Foreign Application Priority Data

Feb. 12, 1997 [GB] United Kingdom ..... 9702836

[51] Int. Cl.[7] ..... F01C 1/18

[52] U.S. Cl. ..... 418/206.1; 418/206.5

[58] Field of Search ..... 418/206.5, 206.1

[56] References Cited

U.S. PATENT DOCUMENTS

| | | | |
|---|---|---|---|
| Re. 29,627 | 5/1978 | Wheatherston | 418/206.1 |
| 3,844,695 | 10/1974 | Wheatherston | 418/206.1 |
| 3,941,521 | 3/1976 | Wheatherston | 418/206.1 |
| 4,033,708 | 7/1977 | Wheatherston | 418/206.1 |
| 4,076,469 | 2/1978 | Wheatherston | 418/206.1 |
| 4,437,818 | 3/1984 | Wheatherston | 418/206.1 |
| 4,797,077 | 1/1989 | Anderson | 418/206.1 |
| 4,938,670 | 7/1990 | Lee | 418/206.1 |
| 5,039,289 | 8/1991 | Eiermann et al. | 418/206.1 |
| 5,559,288 | 9/1996 | Shumacher | 418/206.1 |
| 5,788,473 | 8/1998 | Buse | 418/206.1 |

*Primary Examiner*—Thomas Denion
*Assistant Examiner*—Thai-Ba Trieu
*Attorney, Agent, or Firm*—Kenyon & Kenyon

[57] ABSTRACT

Fluid being pumped by rotary piston/lobe pumps is prone to fluid cavitation particularly at the leading and trailing edges of the rotor.

A rotor 10 comprises a generally cylindrical rotor hub portion 108 formed with two piston wing portions 110, 111. The piston wing portions 110, 111 are disposed transversely of the axis 13 on a substantially flat surface 112 of the hub portion 108. Extending from the surface 112 coaxially with axis 13, and disposed radially within the rotor hub portion 108, is a tubular portion 114 through which the end of shaft 15 passes when the rotary pump assembly is in an assembled state.

Each piston wing portion 110, 111 is formed with a sinuous curved leading face region 113 and a sinuous curved trailing face region 115.

The radially outermost (relative to the rotor axis) region of the leading face region 113 is formed with a leading curved edge part 116 and the radially outermost region of the trailing face region is formed with a trailing curved edge part 118.

24 Claims, 11 Drawing Sheets

ROTOR FOR USE IN A ROTARY PUMP

BACKGROUND OF THE INVENTION

This invention relates to a rotor for the use in a rotary pump and is particularly, but not exclusively, concerned with rotors for a rotary-piston/lobe pump Fluid being pumped by rotary-piston/lobe pumps is prone to fluid cavitation particularly at the leading and trailing edges of the rotor. The problem of fluid cavitation is greatest at higher rotor rotation speeds.

SUMMARY OF THE INVENTION

According to a first aspect of the present invention there is provided at least one pump rotor mounted for rotation about a central axis comprising a continuous curved leading edge profile formed by at least one radius and/or a continuous curved trailing edge profile formed by at least one radius.

Preferably the leading edge profile is formed by a plurality of adjacent portions of radii. The trailing edge is preferably formed by a plurality of adjacent portions of radii.

The leading edge profile curve and the trailing edge profile curve are preferably formed by five adjacent portions of radii.

The radially outermost, relative to the rotor axis, radius portion is preferably the smallest in size relative to the other radius portions.

The radially innermost, relative to the rotor axis, radius portion is preferably the largest in size relative to the other radius portions. The size of the radii portions starting from the radially outermost radius to the radially innermost radius preferably ascends in size.

The continuous curve profile is preferably a sinuous cardoidal-like shape.

There is preferably provided a pair of inter-engaging rotors mounted for rotation about substantially parallel axes. The rotors are preferably mounted in a rotary-piston/lobe pump.

According to a second aspect of the present invention there is provided at least one pump rotor mounted for rotation about a central axis formed with at least one channel recess extending from the leading face of the rotor into the rotor and/or at least one channel recess extending from the trailing face of the rotor into the rotor.

The first channel recess is preferably disposed substantially radially below the leading edge of the leading face. The second channel recess is preferably disposed substantially radially below the trailing edge of the trailing face.

Each channel is preferably defined by two substantially parallel side portions extending perpendicularly from the surface of the respective leading and trailing faces and a channel base portion connecting the first side portion to the second side portion; the channel base portion being formed by a curve as viewed axially of the rotor. Preferably, as viewed axially of the rotor, the channel curve of the base portion comprises one concave radius portion and two convex radii portions disposed at opposite ends of the concave radius portion. The channel curve of the base portion is preferably formed with a substantially 'U' shaped cross-section.

Preferably the pump rotor comprises four channels, the arrangement being such that a channel is disposed in each of the two leading faces of the rotor and a channel is disposed in each of the trailing faces of the rotor, the channels being disposed equidistant from the axis of the rotor.

Preferably there is a pair of inter-engaging rotors mounted for rotation about substantially parallel axes.

The rotors are preferably mounted for use in a rotary-piston/lobe pump.

According to a third aspect of the present invention there is provided a pump rotor comprising a continuous curved leading edge profile and continuous curved trailing edge profile and at least one channel formed in the leading face of the rotor and a channel formed in the trailing face of the rotor, the arrangement being such that in use cavitation of a fluid worked on by the rotor is substantially prevented.

The rotor preferably rotates at speeds of up to 1400 rpm. It will be appreciated that the maximum speeds achievable depend upon the particular viscosity of the working fluid.

According to a fourth aspect of the present invention there is provided pump rotor removal means comprising at least one channel recess extending from the rotor face into the rotor.

An embodiment of the invention will now be described, by way of example only, with reference to the accompanying drawings, wherein:

DETAILED DESCRIPTION OF THE INVENTION

Figure 1:
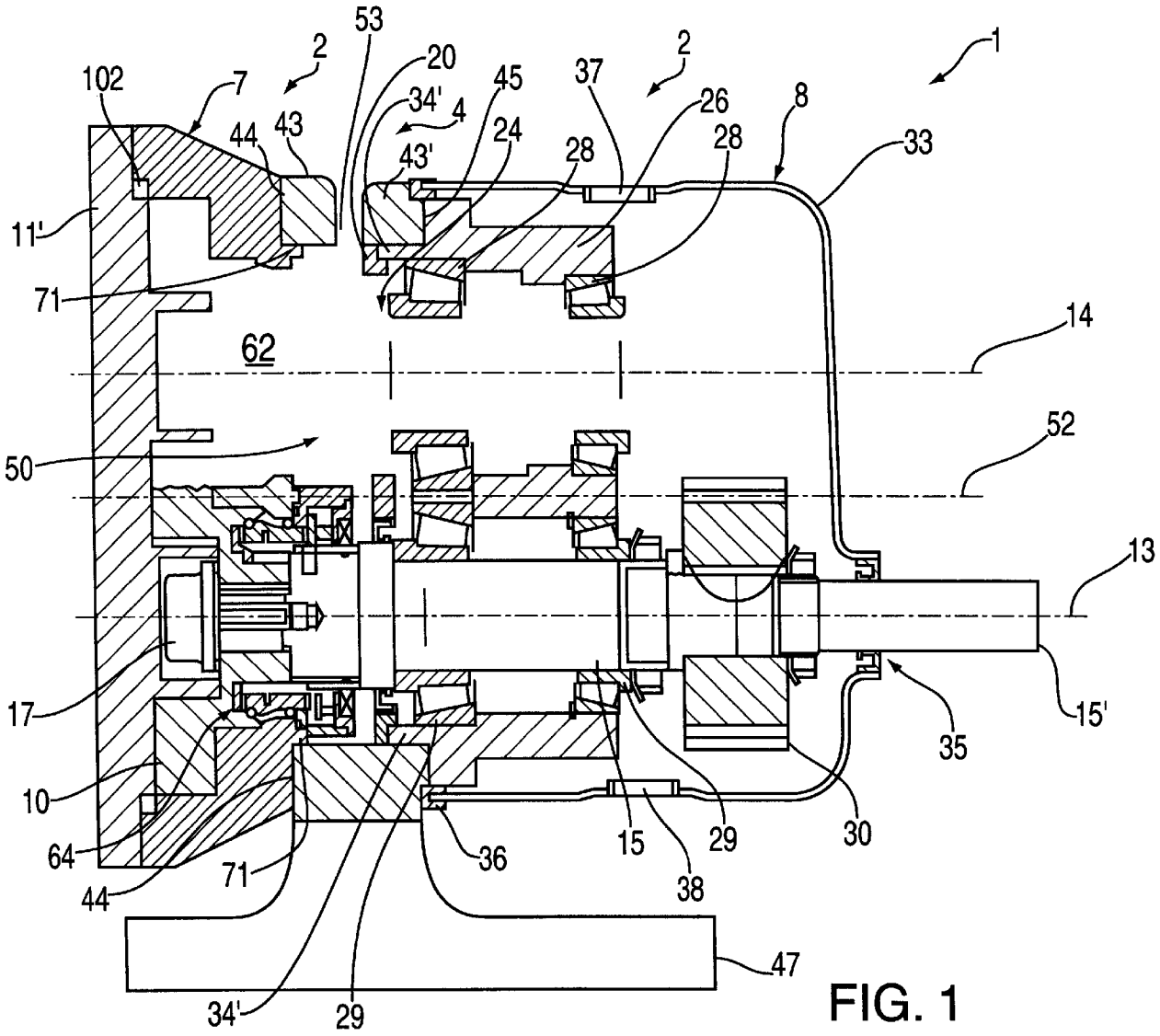
FIG. 1 is a vertical section through a rotary pump assembly and shows the assembly of one of the piston/lobe rotors mounted on a drive shaft, the other piston/lobe rotor and associated shaft being omitted.
Figure 2:
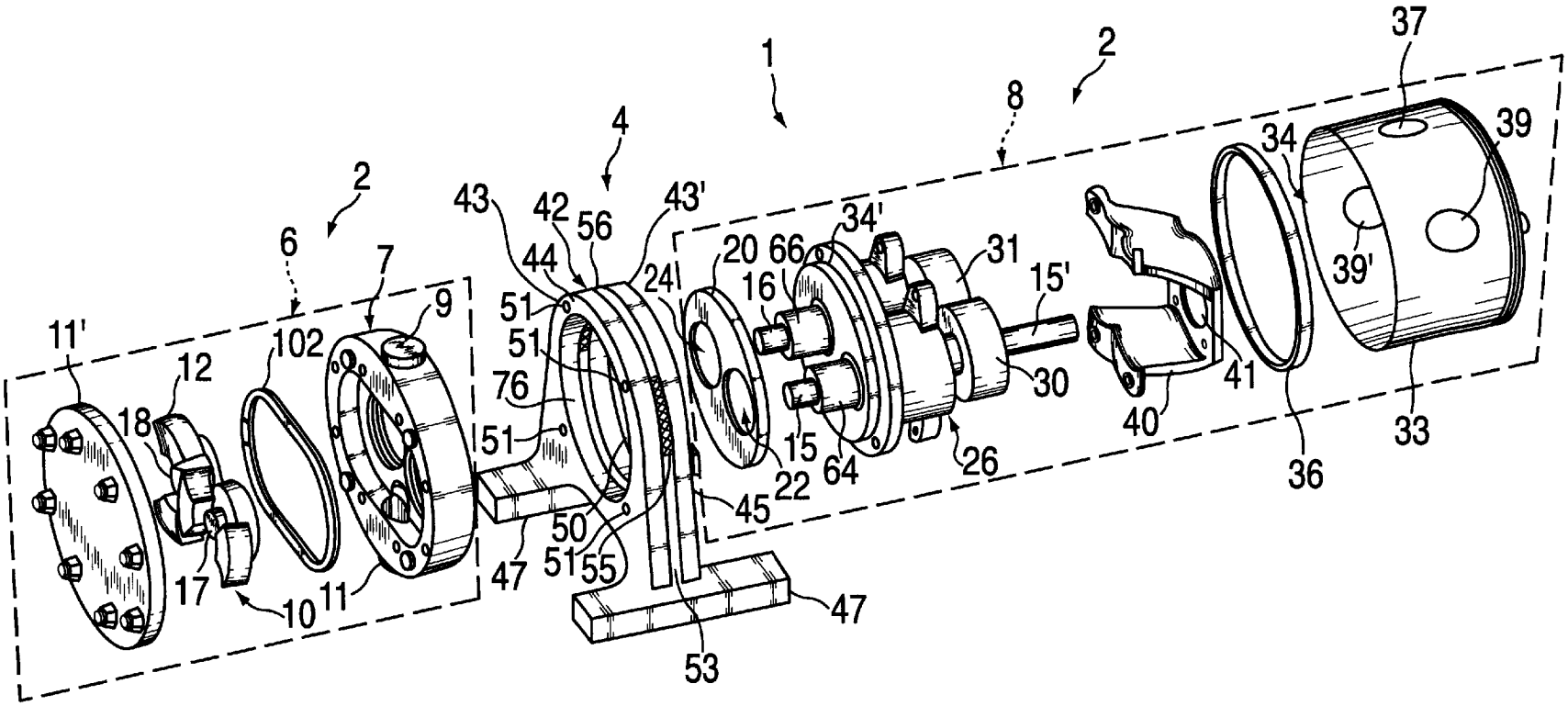
FIG. 2 is an exploded isometric view of the components of the pump assembly.

With reference to FIGS. 1 to 4 of the drawings, a rotary pump assembly 1 comprises a rotary pump 2 and pump mounting means 4. The rotary pump 2 comprises a rotor containing assembly 6 and a gear containing assembly 8.

The rotor containing assembly 6 comprises a pair of inter-engaging piston/lobe rotors 10, 12 mounted for contra-rotation within a rotor case portion 7 about substantially parallel axes 13, 14; the rotor case portion is formed with an inlet port 9 and an outlet port 11 and comprises a circular cover plate $\mathbf{11}^1$.

Substantially parallel shafts 15, 16 also mounted for rotation about the axes 13, 14 respectively , are connected to the respective rotors 10, 12.

The rotors 10, 12 are secured on to the respective shafts 15, 16 by clamping/retaining nuts 17, 18.

The shafts 15, 16 extend from the rotor containing assembly 6 along the axes 13, 14 through the mounting means 4 and into the gear containing assembly 8.

Shaft 15 is a drive shaft and is driven by an electric motor (not shown) suitably attached at the shaft end 15[1]. Prime movers other than electric motors may be used. It will be appreciated that by reversing the direction of the electric motor the direction of fluid flow through the pump containing assembly 6 will be reversed. Accordingly the port 9 will act as the fluid output port and the port 11 will act as the fluid inlet port.

The gear containing assembly 8 comprises a substantially circular chassis plate 20 formed with two circular ports 22, 24; a chassis structure 26 suitably formed to house two sets of tapered roller bearing assemblies 28, 29 and carrying a pair of gears 30, 31 mounted on respective shafts 15, 16 for contra-rotation about the respective axes 13, 14. The gear containing assembly 8 also comprises a cup-shaped enclosure 33 formed with an open end 34 and a port 35 through which the shaft end 15[1] extends, a lubricant filling port 37 formed through the uppermost region of the enclosure wall and a lubricant drain port 38 formed through the lowermost region of the enclosure wall (see FIG. 1). The enclosure 33 is also formed with two substantially circular fluid level viewing ports 39, 39[1] disposed generally facing each other and being in an orientation 90° from the ports 37, 38 respectively. It will be appreciated that when the orientation of the rotor containing assembly 6 and gear containing assembly 8 is changed from the vertical to the horizontal orientation the viewing ports 39, 39[1] may be then used as either filling or draining ports and the inlet port 9 and outlet port 11 may be used as fluid level viewing ports. The material used to plug the four ports 37, 38, 29 and 39[1] has appropriate transparent properties.

The enclosure 33 is mounted upon an internal support structure 40 which is formed with a port 41 through which the shaft 15 extends. The enclosure 33 is not subjected to substantial stresses during the operation of the pump 1 and the primary function of the enclosure 33 is to contain lubrication fluid within the gear containment assembly 8.

When the enclosure 33 is mounted on the support structure 40 the open end 34 abuts a sealing ring 36 which provides fluid sealing means between the enclosure 33 and the mounting means. Lubrication fluid is placed within the assembly 8 through the port 37 and provides lubrication means for the component parts within the enclosure 33.

The mounting means 4 comprises a substantially vertical portion 42 comprising two substantially parallel flat mounting surfaces 44, 45 facing in opposite directions. From the lowermost region of the portion 42 there extends a pair of horizontal foot members 47.

The portion 42 is formed with a circular through port 50 extending along axis 52 (see FIG. 1). The portion 42 is also formed with a vertical slot 53 which extends through the portion 42 transverse to the axis 52, so forming two substantially parallel vertical portions 43, 43[1]. The mounting surfaces 44, 45 are each formed with four threaded bolt holes which extend from the surfaces 44, 45 through the respective portions 43, 43[1].

Disposed at the upper region of the portion 42 are two bridging portions 55, 56 extending from the outermost surface of the portion 42 into the slot 53. (See FIG. 2.)

The chassis structure 26 of the gear containing assembly 8 is formed with an annular rim 34[1] extending from the chassis structure 26 into the through port 50 of the mounting mean 4. The radially outermost surface of the annular rim 34[1] is in sliding contact with the radially innermost surface of the portion 42.

Figure 3:
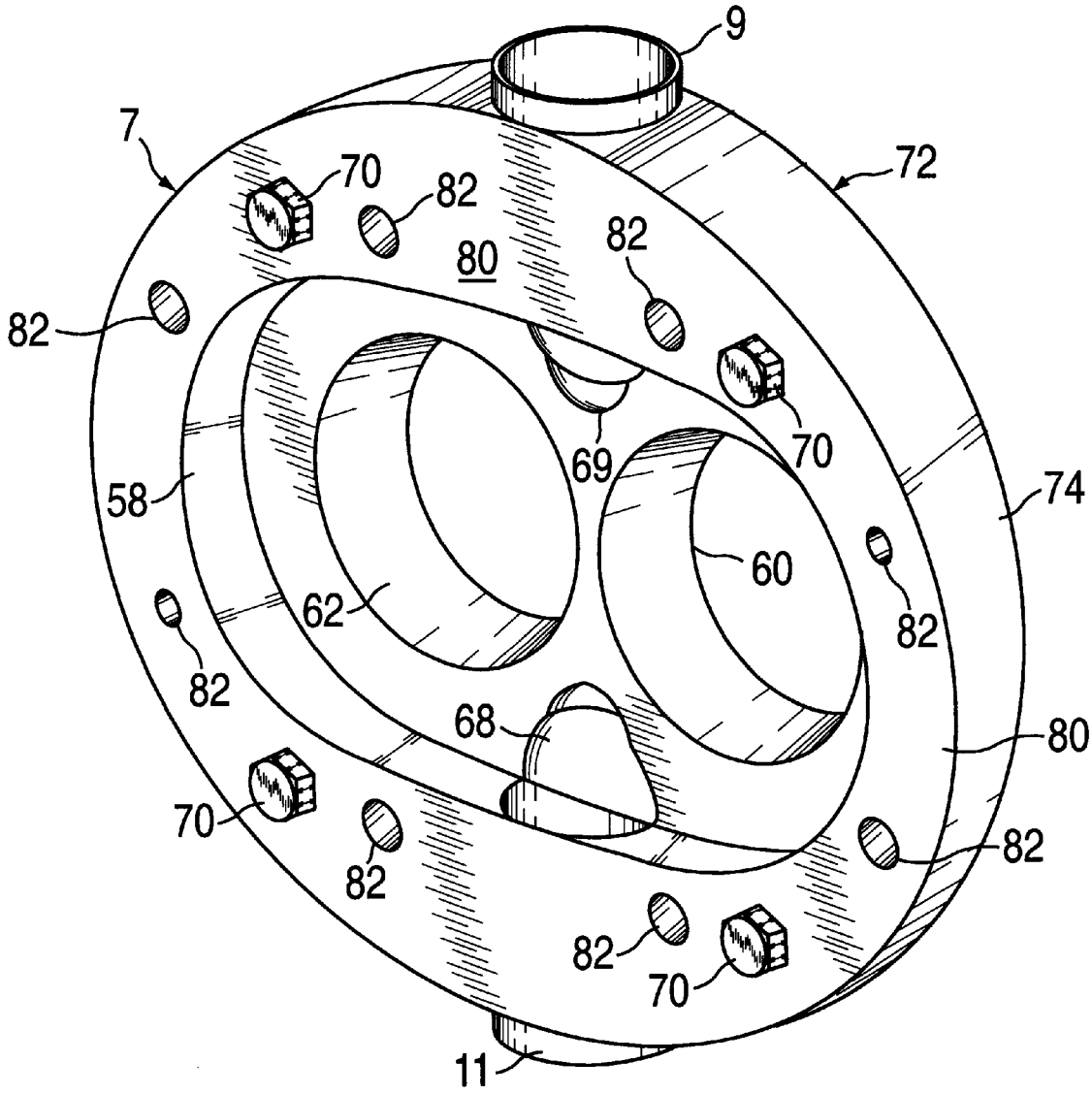
FIG. 3 is a isometric view of a rotor case portion.

Referring to FIG. 3, the rotor case portion 7 is formed with a generally oval shaped rotor recess 58 adapted to house the lobe rotors 10, 12. Two substantially circular through hub bore ports 60, 62 extend from the rotor recess 58 coaxially along respective axes 13, 14 and are formed so as to receive seal assemblies 64, 66 disposed on respective shafts 15, 16.

The inlet port 9 and outlet port 11 extend into the rotor bore 58 from opposing directions. At the innermost part of the inlet port 9 and outlet port 11 there are formed curved scallops 68, 69.

The rotor case portion 7 is attached to the mounting surface 44 of the mounting means 4 by means of rotor case threaded bolts 70.

The rotor case portion 7 is formed with an annular rim 71 extending from the case portion 7 into the through port 50 of the vertical portion 43. The radially outermost surface of the annular rim 71 is in sliding contact with the radially innermost surface of the vertical portion 43.

The rotor case portion 7 comprises a flat surface 80 substantially perpendicular to the axes 13, 14. Extending from the mounting surface 80 and through the rotor case portion 7 there are eight threaded bolt holes 82.

Figure 4:
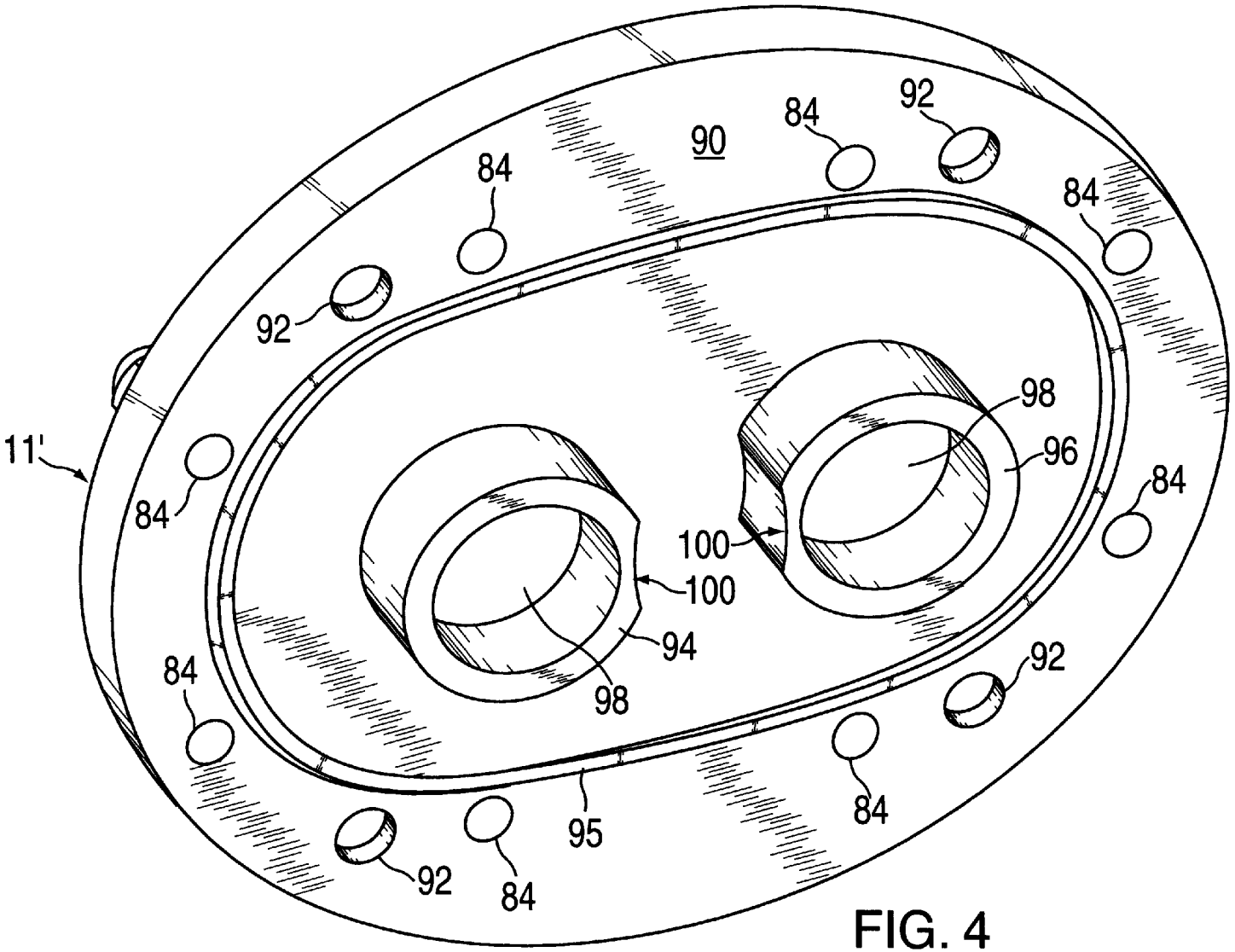
FIG. 4 is an isometric view of a pump cover plate formed with spigot pillars.
Figure 5:
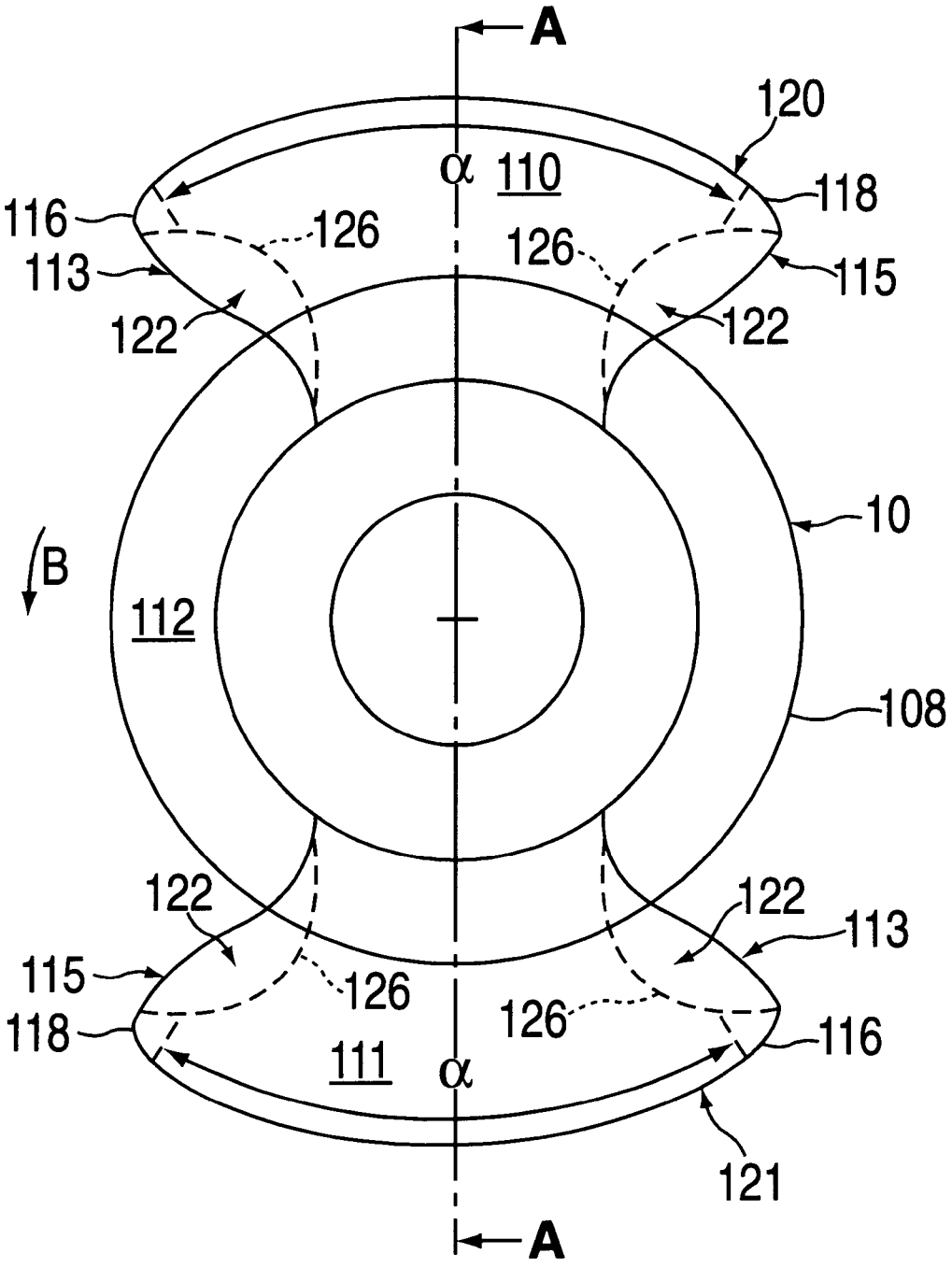
FIG. 5 is a plan view of a rotor.
Figure 6:
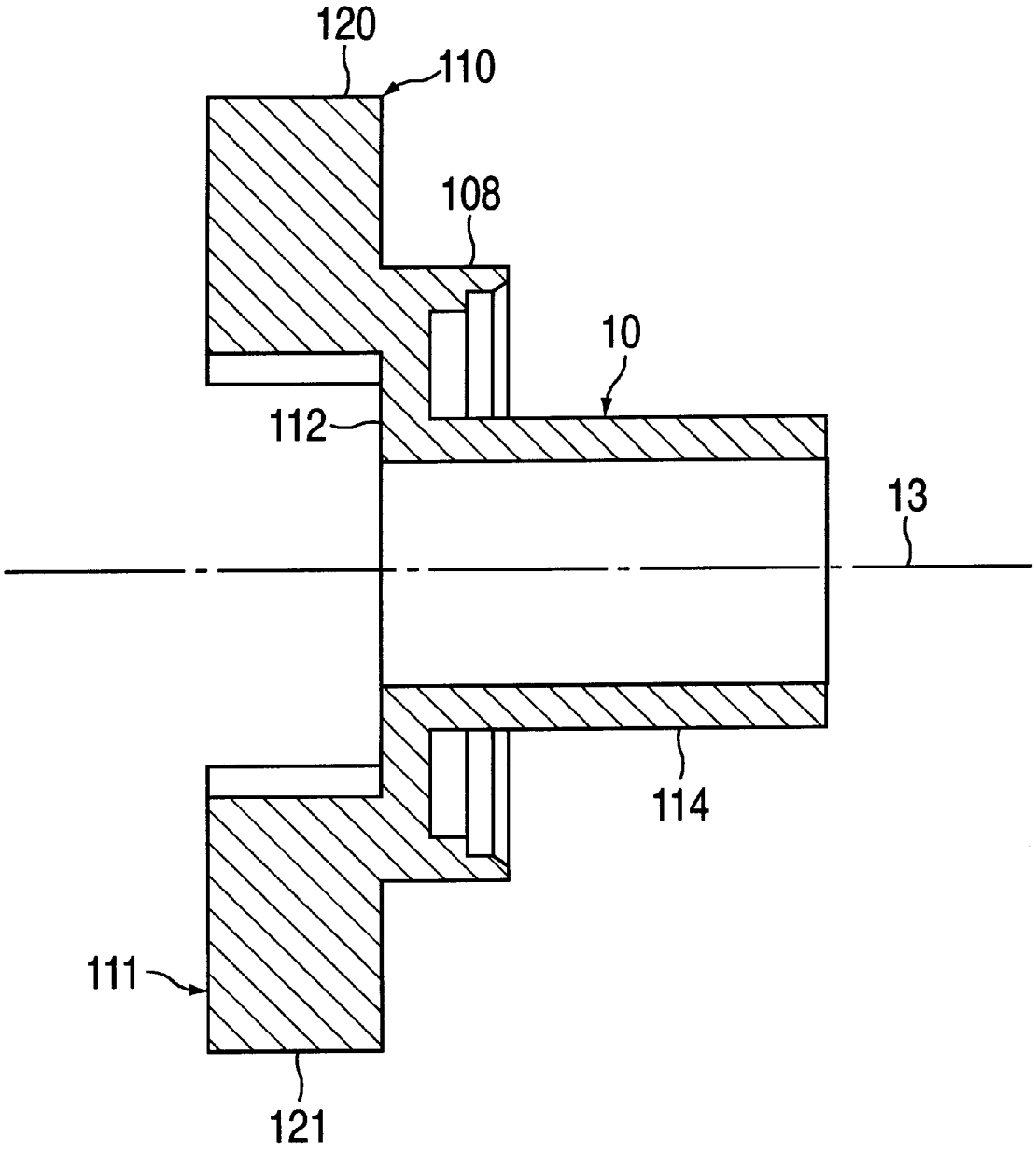
FIG. 6 is a cross-section of the rotor through A—A.
Figure 7:
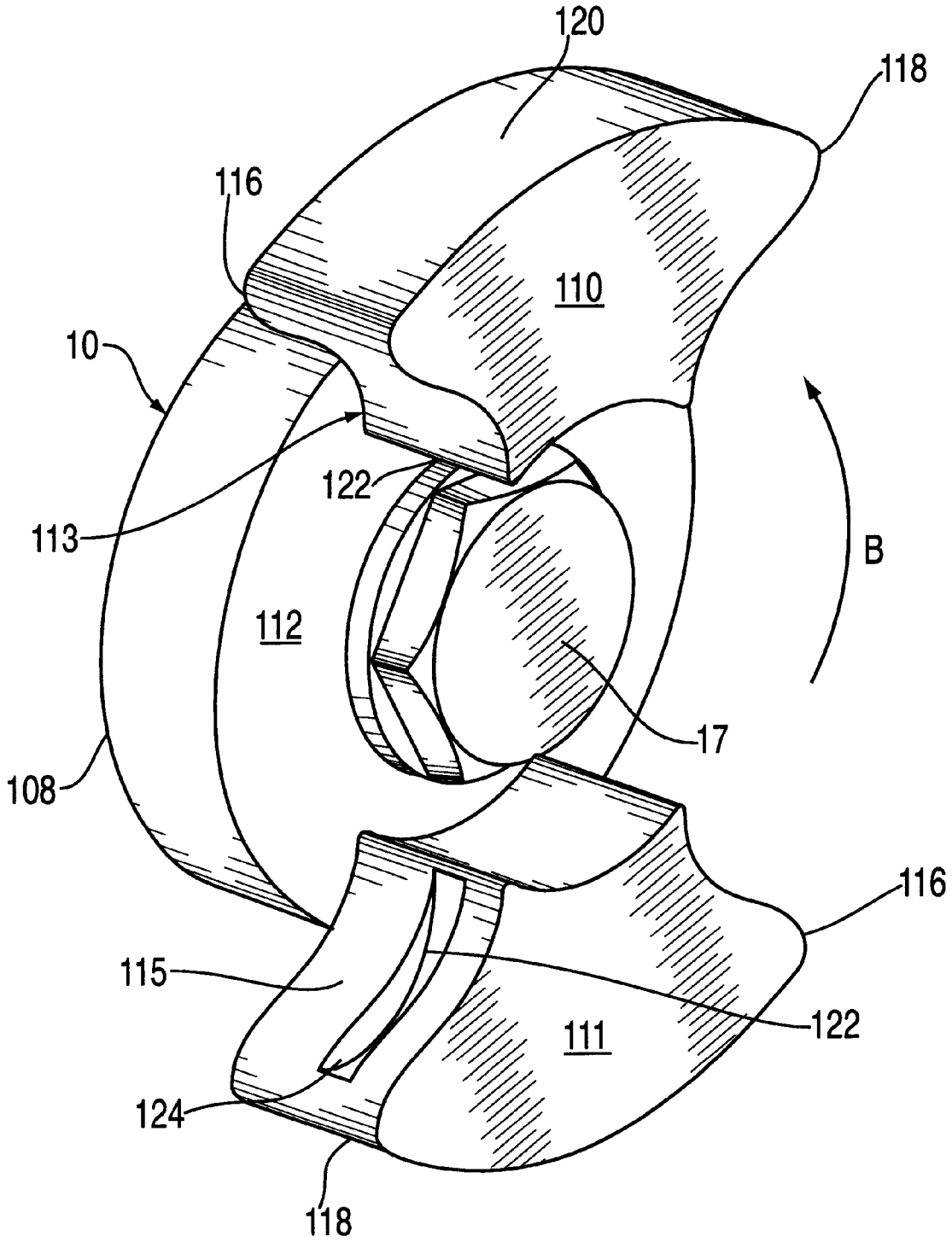
FIG. 7 is a front isometric view of the rotor showing a retaining nut.
Figure 8:
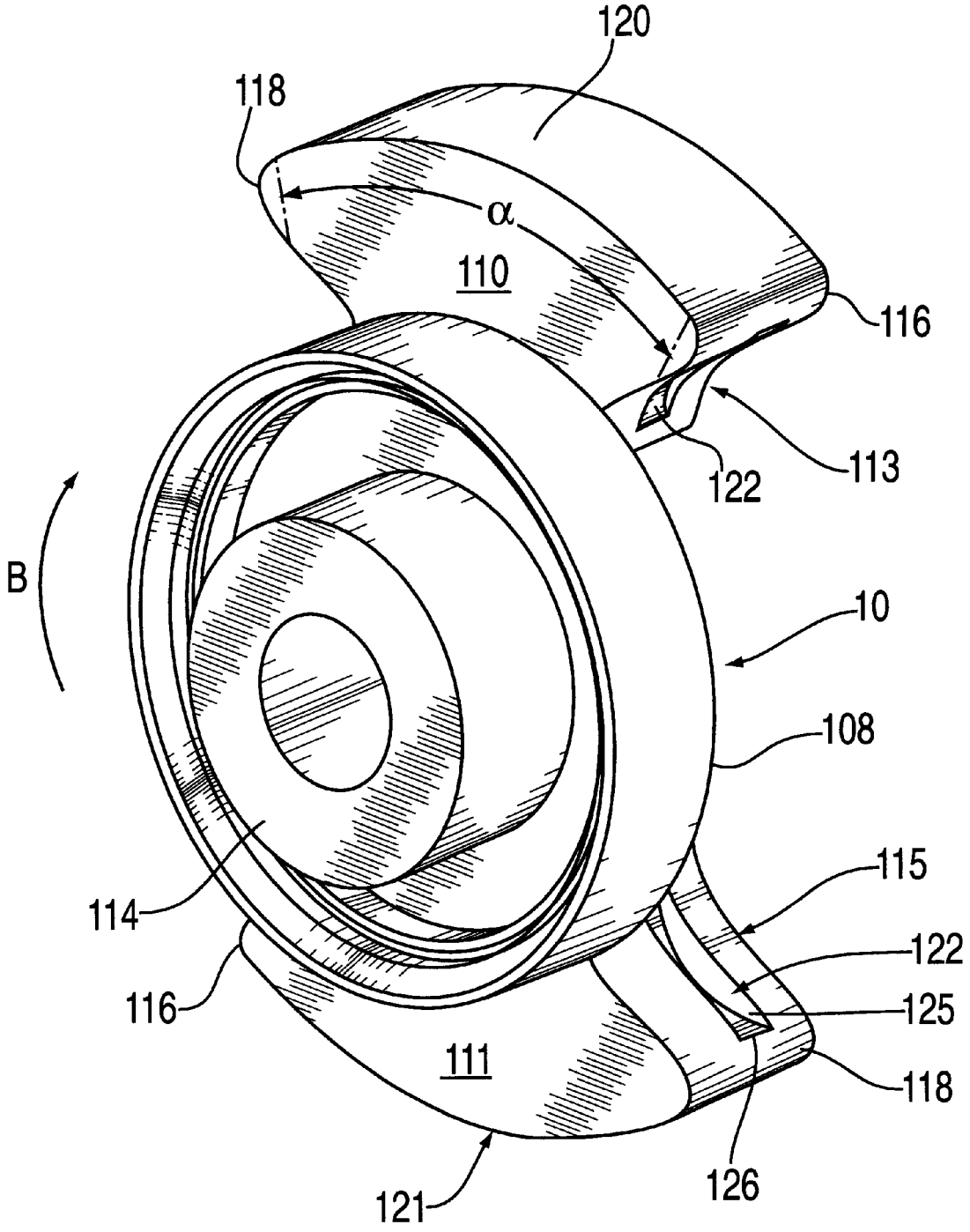
FIG. 8 is a rear isometric view of the rotor.

Referring to FIG. 4, the cover plate 11[1] is formed with bolt holes 84 extending therethrough and arranged so that they align with the respective holes 82 in the rotor case portion 7. Extending from a flat mounting surface 90 into the cover plate 11[1] there are four recesses 92 formed to receive the bolt heads of the rotor case bolts 70. The cover plate 11[1] is also formed with a generally oval shaped channel recess 95 extending from the mounting surface 90 into the cover plate 11. The recess 95 is disposed radially within the recesses 92 and the holes 84. The cover plate 11[1] comprises two stationary substantially circular spigots 94, 96 each formed with a recess 98 provided to receive the retaining nuts 17, 18. The outermost wall of each of the spigots 94, 96 is formed with curved scallop 100 formed to allow the rotation of the rotors 12, 10.

When the cover plate is bolted to the rotor case 7 an oval seal ring 102 is located within the oval recess 94 and provides sealing means between the mounting surfaces 80 and 90, so containing fluid being pumped from the inlet port 9 through the recess 58 and out through the outlet port 11.

When the rotary pump assembly 1 is in a substantially disassembled state the orientation of the rotor containing assembly 6 and the gear containing assembly 8 can be rotated by angular intervals of 90° apart, relative to the pump mounting means about the central axis 52 and subsequently reassembled.

It will be appreciated that the orientation of the gear containing assembly 8 and the rotor containing assembly 6 about the axis 52 depends upon the orientation of the fixing holes 51 about the central axis 52. The rotation of the rotor containing portion and the gear containing portion relative to the mounting frame is substantially prevented by means of at least one dowel-like protrusion (not shown) extending from the respective mounting faces of the rotor containing portion and the gear containing portion; the protrusions being engaged, in use, in corresponding recesses (not shown) formed in the respective mounting surfaces of the mounting frame. The four holes 51 can be disposed in any required rotation about the axis 52 from the vertical plane such that the gear containing assembly 6 and rotor containing assembly are disposed in the required orientation about the axis 52.

The features of one of the rotors will now be described, however the rotors 10, 11 are substantially the same shape formed and with essentially identical features.

Referring to FIGS. 5 to 10, the rotor 10 comprises a generally cylindrical rotor hub portion 108 formed with two piston wing portions 110, 111. The piston wing portions 110, 111 are disposed transversely of the axis 13 on a substantially flat surface 112 of the hub portion 108. Extending from the surface 112 coaxially with axis 13, and disposed radially within the rotor hub portion 108, is a tubular portion 114 through which the end of shaft 15 passes when the rotary pump assembly is in an assembled state.

Each piston wing portion 110, 111 is formed with a sinuous curved leading face region 113 and a sinuous curved trailing face region 115.

The radially outermost (relative to the rotor axis) region of the leading face region 113 is formed with a leading curved edge part 116 and the radially outermost region of the trailing face region is formed with a trailing curved edge part 118.

Figure 9:
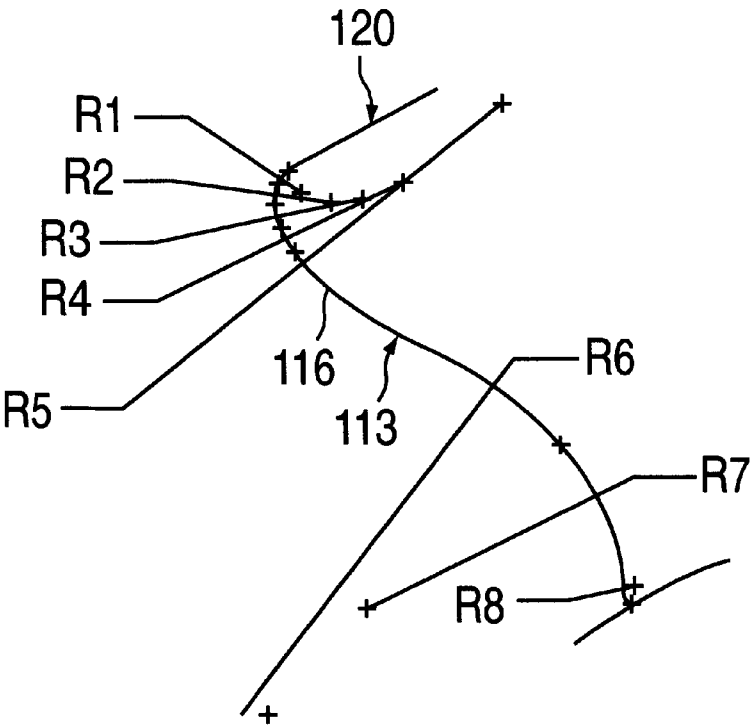
FIG. 9 is a plan view of a curved leading edge profile of the rotor.

Referring to FIG. 9, the respective leading and trailing curved edge parts 116 and 118 each comprise a smoothly continuous convex curved profile formed by adjacent portions of radii R1, R2, R3, R4 and R5. The said radii ascend in size, from R1 being the smallest in value to R5 being the largest in value.

Disposed radially below (relative to the rotor axis) each of the curved edge parts 116, 118 is a smoothly continuous concave curved profile formed by adjacent portions of radii R6 and R7. The radius R6 is of a greater size than the radius R5. The radius R7 is of a lesser size than R6. Disposed radially below the radius R7 is a concave portion formed by radius R8.

Typical values for the radii are as follows:

R1=1.29

R2=2.8

R3=4.43

R4=6.75

R5=13.42

R6 32 21.97

R7=13.35

R8=0.5

The respective radially outermost surfaces 120, 121 of the piston wing portions 110, 111 extend between the leading edge region 116 and the trailing edge region 118 of the wing portion 110, 111 respectively. In use the rotor 10 rotates about axis 13 in direction B. The rotor 11 rotates about axis 14 in direction C (see FIG. 11).

The angle between the two lines where the outermost surfaces 120, 121 meet the respective curved leading edge and curved trailing edge is called the outer landangle $\alpha$.

Figure 12:
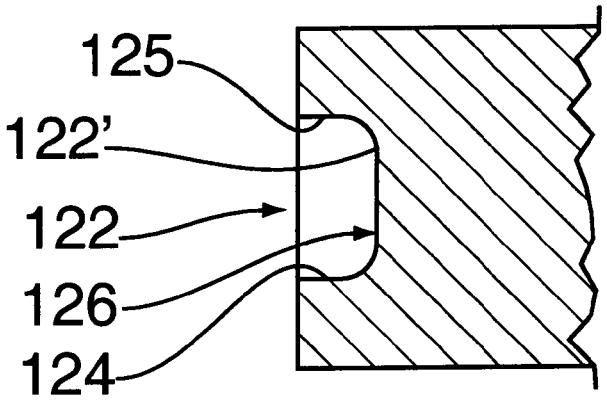
FIG. 12 is a cross section of the channel recess through B—B.

Each curved leading face region 113 and each curved trailing face region 115 are respectively formed with channel recesses 122. Each channel recess 122 is defined by two substantially parallel sides 124, 125 extending perpendicularly from the surface of the face regions into the respective piston wing portions 110, 111 and a curved channel base 126 extends between the parallel sides 124, 125. The curved channel base 126 is formed with a substantially 'U' shaped transverse cross-section $122^1$ (See FIG. 12).

Figure 10:
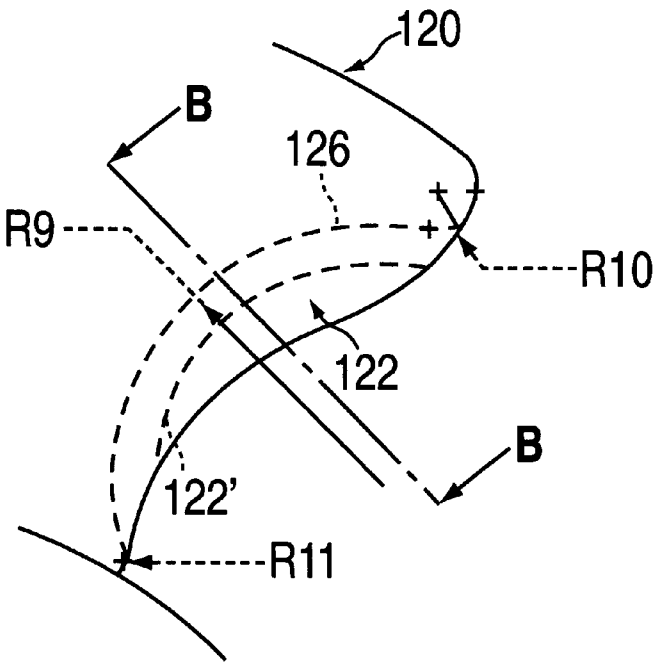
FIG. 10 is a plan view of a channel recess extending from the trailing face of the rotor.

With reference to FIG. 10, the base 126, as viewed axially of the rotor, is formed by a concave radius portion R9 and two convex radius portions R10, R11 disposed at opposite ends of the radius portion R9. The radius R9 is of greater size than both the radii R10 and R11.

Typical values for the radii are as follows:

R9=13.82

R10=2.0

R11=0.5

Figure 11:
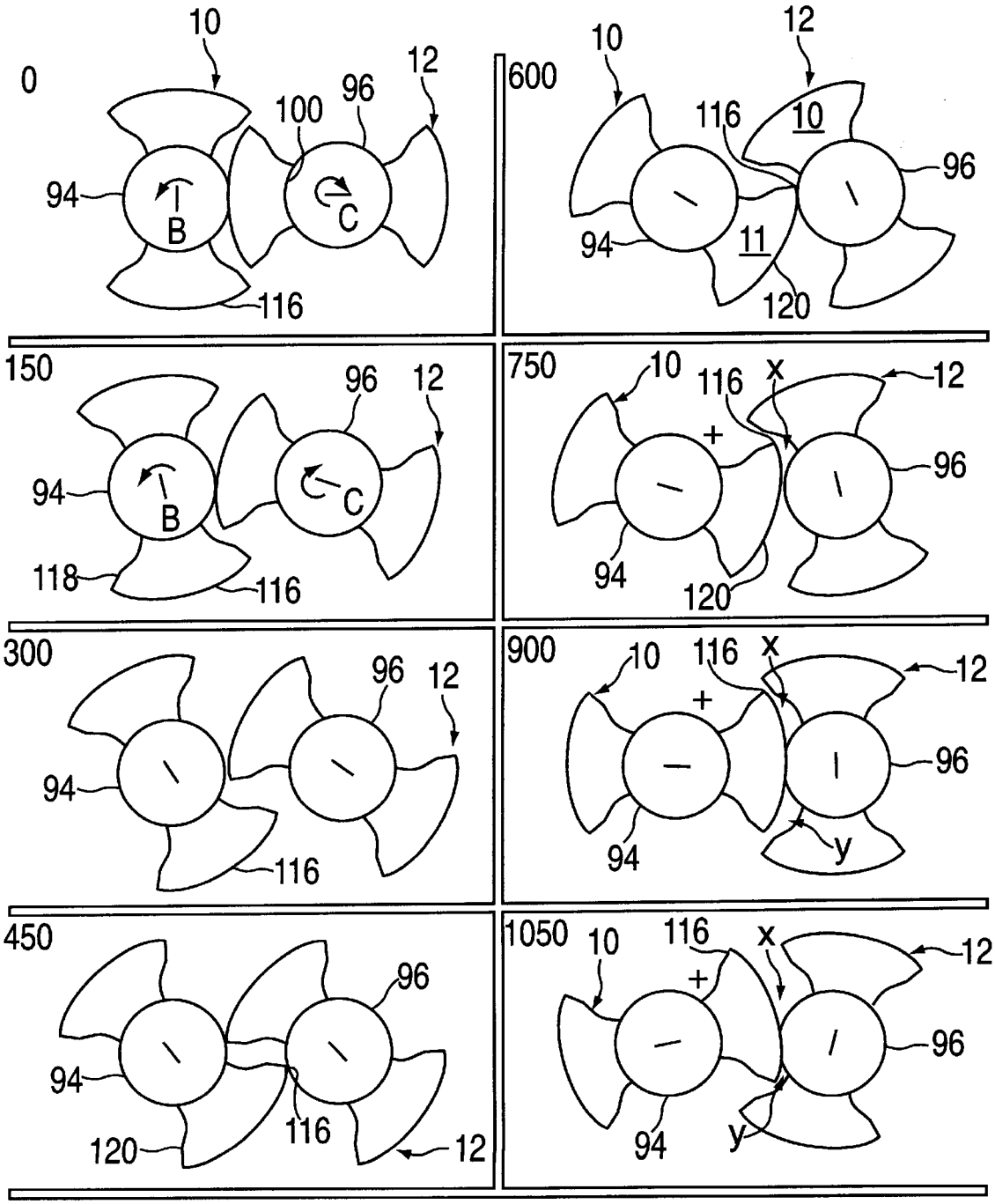
FIG. 11 is a number of schematic views of the relative orientation of the contra-rotating rotors over a period of time.

Referring to FIG. 11 the contra-rotating rotors 10, 12 rotate in directions B, C and have a 90° offset with respect to each other's orientation. As the two rotors 10, 12 rotate the leading edge part 116 of rotor 10 approaches the stationary circular spigot 96 as shown in frame 450. With the continuing rotation of the two rotors the outermost surface 120 of the rotor 10 passes closely by the scallop 100 and an increasing volume X is created between the rotors 10, 12 (see frames 750, 900 and 1050). FIG. 11 does not show the detail of the curved rotor and the rotors shown in FIG. 11 are only pictorial representations.

During the particular orientation previously described, fluid entering the rotor case 7 via the inlet port 9 will flow into the increasing volume X as the rotors 10, 12 rotate. The passage of the fluid flow into the volume X is aided by the curved trailing face region 115 and the curved leading face 113 of the wing portions 110, 111. Of particular importance is the curved edge parts 116, 118.

The passage of the fluid flow into the volume X is also aided by the channel recesses 122.

The fluid flow is aided to such an extent that fluid cavitation is substantially reduced and ideally prevented. Due to the curved face regions of the rotor and the channel recesses the rotors are able to rotate up to speeds of 900 to 1400 rpm without any substantial fluid cavitation.

The curved surfaces of the rotors and the channel recess also aid the fluid flow out of the decreasing volume Y.

It will be appreciated that the Channel recesses 112 in the leading faces 113 and trailing faces 118 of each of the rotors 10, 12 provide an increased volume which will be filled by fluid as the respective rotors rotate.

The above described features will help reduce unwanted noise which is generated when fluid cavitation occurs.

It will be noted that the channel recesses 112 may also be used to remove the rotors 10, 12 from the shafts 15, 16 during disassembly of the rotary pump assembly.

An appropriate tool is placed within the recesses 112 and the rotors 10, 12 withdrawn from the shafts 15, 16. The recesses 112 may also be used during the assembly of the rotary pump assembly.

What is claimed is:

1. A pump including first and second rotors, the first rotor forming first piston wing portions and the second rotor forming second piston wing portions, the first and second piston wing portions rotating during operation of the pump without meshing with one another, the first rotor being mounted for rotation about a central first rotor axis and comprising at least one continuous curved edge profile wherein the at least one continuous curved edge profile is one of a continuous curved leading edge profile formed by at least one radius and a continuous curved trailing edge profile formed by at least one radius.

2. A pump rotor as claimed in claim 1 wherein the leading edge profile is formed by a plurality of adjacent portions of radii.

3. A pump as claimed in claim 2 wherein the leading edge profile curve and the trailing edge profile curve are formed by five adjacent portions of radii.

4. A pump as claimed in claim 2 wherein relative to the rotor axis, the radially outermost radius portion is the smallest in size relative to the other radius portions.

5. A pump as claimed in claim 2 wherein relative to the rotor axis, the radially innermost, radius portion is the largest in size relative to the other radius portions.

6. A pump as claimed in claim 2 wherein the size of the radii portions starting from the radially outermost radius to the radially innermost radius ascends in size.

7. A pump as claimed in claim 1 wherein the trailing edge profile is formed by a plurality of adjacent portions of radii.

8. A pump as claimed in claim 1 wherein the at least one continuous curved profile is a sinuous cardoidal-like shape.

9. A pump as claimed in claim 1 wherein the second rotor is mounted for rotation about a second rotor axis substantially parallel to the first rotor axis for interengaging rotation with the first rotor.

10. A pump as claimed in claim 9 wherein the pump is a rotary-piston/lobe pump.

11. A pump as claimed in claim 1 wherein the first rotor rotates at speeds up to 1400 rpm.

12. A pump as claimed in claim 1 wherein the first rotor defines a radially outermost surface extending along a portion of a circle centered about the first rotor axis and wherein the radially outermost surface is coupled to at least one of the leading edge and the trailing edge of the first rotor by the continuous curved edge profile.

13. A pump including first and second rotors, the first rotor forming first piston wing portions and the second rotor forming second piston wing portions, the first and second piston wing portions rotating during operation of the pump without meshing with one another, the first rotor being mounted for rotation about a first central axis and comprising one of a first channel recess extending into the first rotor from a leading face of the first rotor and a second channel recess extending into the first rotor from a trailing face of the first rotor.

14. A pump as claimed in claim 13 wherein the first channel recess is disposed substantially radially below a leading edge of the leading face.

15. A pump as claimed in claim 13 wherein the second channel recess is disposed substantially radially below a trailing edge of the trailing face.

16. A pump as claimed in claim 15 wherein the channel curve of the base portion as viewed axially of the first rotor comprises one concave radius portion and two convex radii portions disposed at opposite ends of the concave radius portion.

17. A pump as claimed in claim 13 wherein each of the first and second channel recesses is defined by first and second substantially parallel side portions extending perpendicularly from a surface of the respective one of the leading and trailing faces and a channel base portion connecting the first side portion to the second side portion.

18. A pump as claimed in claim 17 wherein the channel base portion is formed by a curve as viewed axially of the rotor.

19. A pump as claimed in claim 17 wherein the channel curve of the base portion is formed with a substantially 'U' shaped cross-section.

20. A pump as claimed in claim 13 wherein the first rotor comprises four channels, the arrangement being such that a channel is disposed in each of the two leading faces of the first rotor and a channel is disposed in each of the trailing faces of the first rotor, the channels being disposed equidistant from the first axis.

21. A pump as claimed in claim 13 wherein the second rotor is mounted for rotation about a second axis substantially parallel to the first axis and wherein the first and second rotors interengagingly rotate about the first and second axes.

22. A pump as claimed in claim 21, wherein pump is a rotary-piston/lobe pump.

23. A pump including first and second rotors, the first rotor forming first piston wing portions and the second rotor forming second piston wing portions, the first and second wing portions rotating during operation of the pump without meshing with one another, the first rotor comprising a continuous curved leading edge profile and having at least one channel formed in a leading face thereof and a channel formed in a trailing face thereof such that, in uses cavitation of a fluid worked on by the first rotor is substantially prevented.

24. Pump rotor removal means comprising at least one channel recess extending from the rotor face into the rotor.

* * * * *